US007921679B2

(12) United States Patent
Jo

(10) Patent No.: US 7,921,679 B2
(45) Date of Patent: Apr. 12, 2011

(54) WASHING/DRYING MACHINE

(75) Inventor: Sung-Hwa Jo, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/230,582

(22) Filed: Sep. 2, 2008

(65) Prior Publication Data

US 2009/0057527 A1 Mar. 5, 2009

(30) Foreign Application Priority Data

Sep. 3, 2007 (KR) ..... 10-2007-0089181

(51) Int. Cl.
*B08B 3/12* (2006.01)

(52) U.S. Cl. ..... 68/3 R; 68/13 R; 312/351.1; 248/678; 248/680; 248/346.01

(58) Field of Classification Search ..... 248/346.3, 248/246.5, 678, 680, 188, 188.1, 188.5, 188.8, 248/639, 309.1, 635, 346.01, 346.02, 346.03; 312/228, 351.1, 351.2, 111; 68/3 R, 13 R
See application file for complete search history.

(56) References Cited

U.S. PATENT DOCUMENTS

| | | | | |
|---|---|---|---|---|
| 3,304,032 | A * | 2/1967 | Yates | 248/649 |
| 4,148,454 | A * | 4/1979 | Carlson et al. | 248/222.11 |
| 4,454,732 | A * | 6/1984 | Burkland et al. | 68/3 R |
| 4,462,225 | A * | 7/1984 | Noe | 68/3 R |
| 4,680,948 | A * | 7/1987 | Rummel et al. | 68/3 R |
| 4,821,535 | A * | 4/1989 | Wassilak et al. | 68/3 R |
| 5,106,039 | A | 4/1992 | Gross | |
| 5,230,553 | A * | 7/1993 | Tuller | 312/228 |
| 5,692,722 | A * | 12/1997 | Lundag.ang.rds | 248/553 |
| 6,203,031 | B1 * | 3/2001 | Leverington | 280/35 |
| 6,345,874 | B2 * | 2/2002 | Duong et al. | 312/351.1 |
| 6,427,966 | B1 * | 8/2002 | Blumenschein | 248/678 |
| 7,275,398 | B2 * | 10/2007 | Kim et al. | 68/3 R |
| 2004/0263032 | A1 * | 12/2004 | Cho | 312/330.1 |
| 2005/0275325 | A1 * | 12/2005 | Yang | 312/330.1 |
| 2007/0119216 | A1 * | 5/2007 | Jeong et al. | 68/3 R |

FOREIGN PATENT DOCUMENTS

| | | |
|---|---|---|
| KR | 10-2004-0053623 A | 6/2004 |
| KR | 10-2004-0085516 A | 10/2004 |
| KR | 10-2004-0086059 A | 10/2004 |

* cited by examiner

*Primary Examiner* — Kimberly T Wood
(74) *Attorney, Agent, or Firm* — Birch, Stewart, Kolasch & Birch, LLP

(57) ABSTRACT

Disclosed is the washing/drying machine having a pedestal, including: a washing/drying machine main body performing a washing or drying operation of laundry; and a pedestal for mounting the main body thereon, wherein a base having legs is coupled at a lower end of the main body, and a supporter having coupling ribs for fixing the base to the pedestal is mounted at an upper surface of the pedestal, thereby preventing a damage to the surface of the pedestal or the washing/drying machine and facilitating mounting/dismounting the supporter or the pedestal.

14 Claims, 5 Drawing Sheets

【Fig. 1】
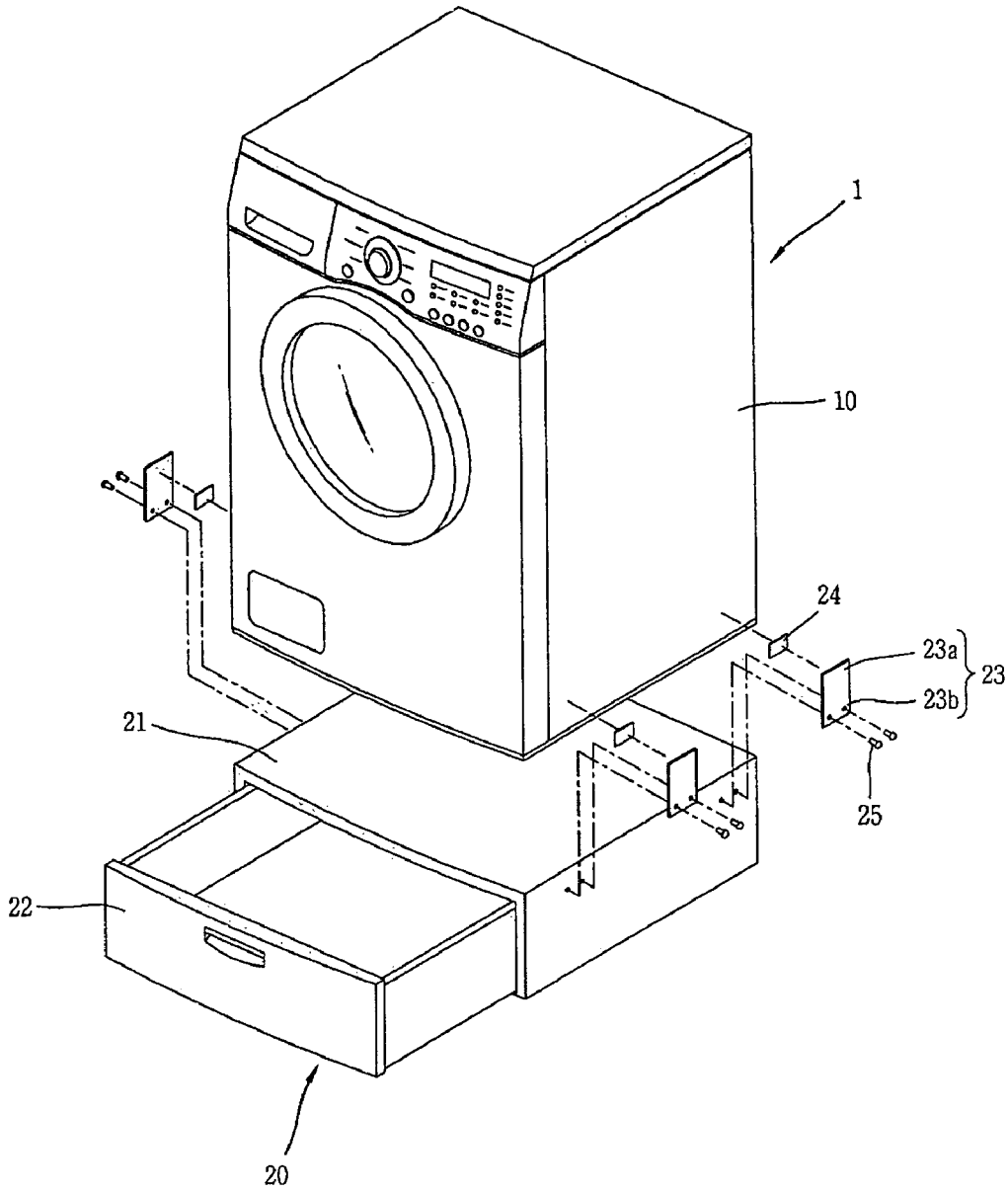

【Fig. 2】
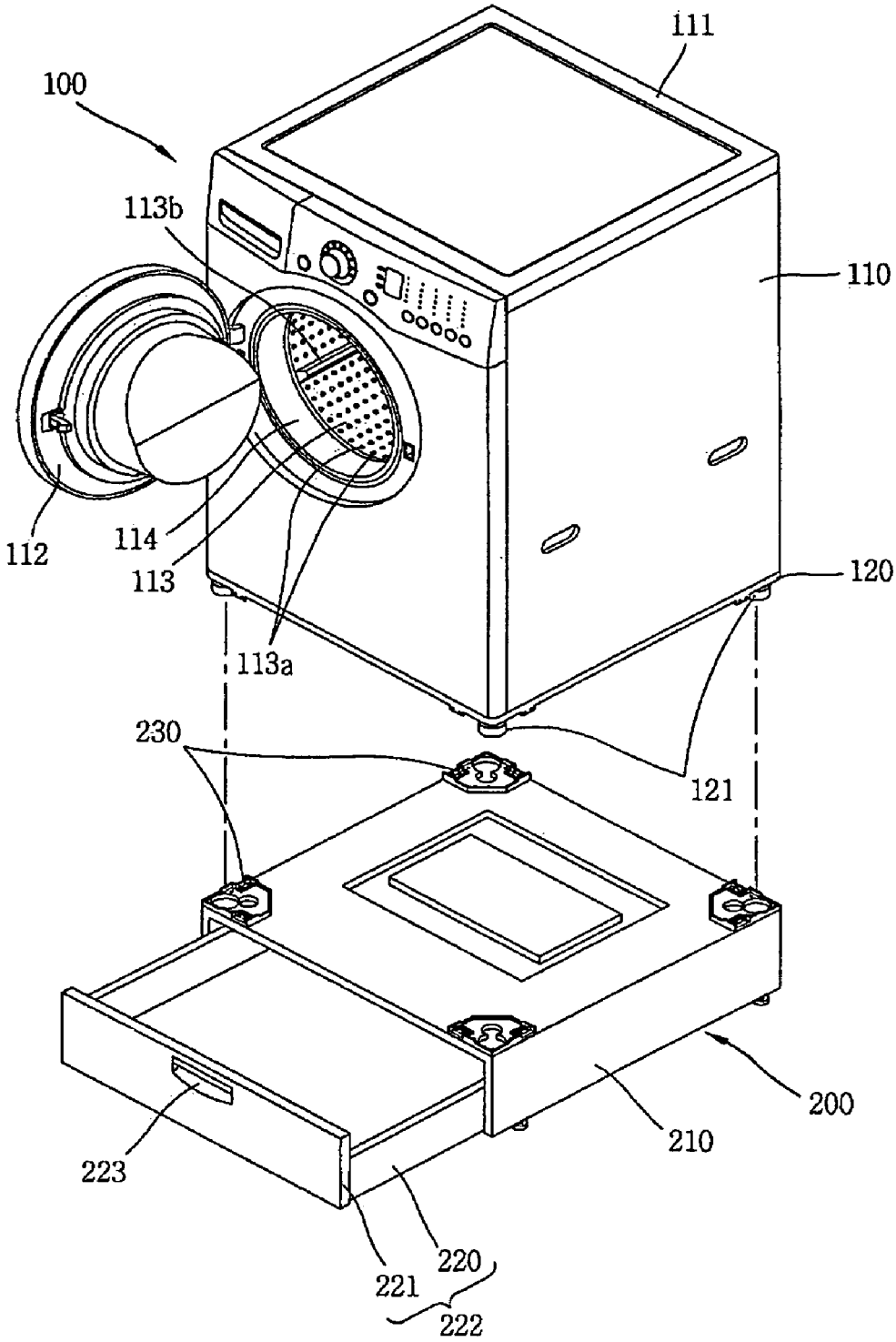

【Fig. 3】
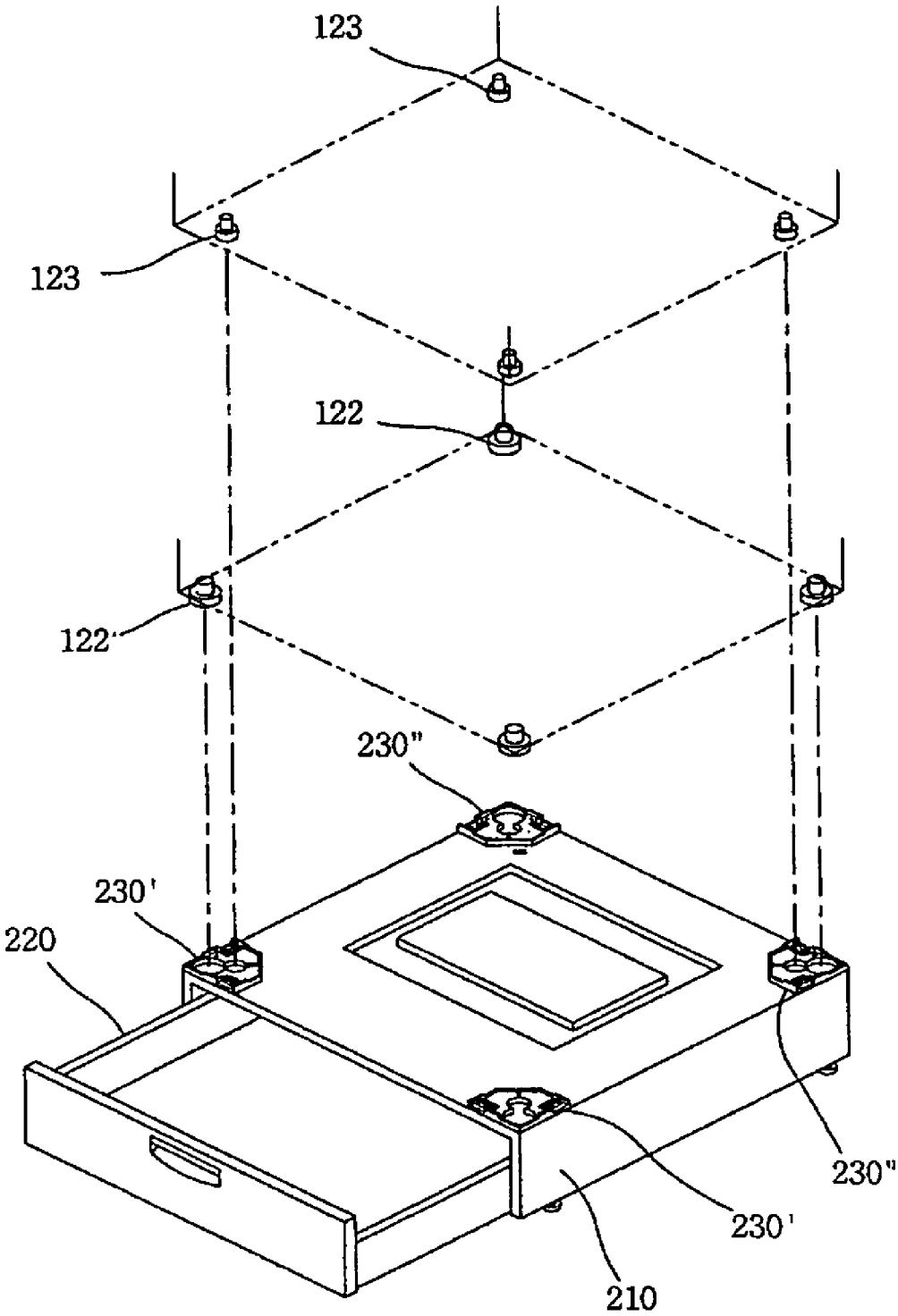

【Fig. 4】
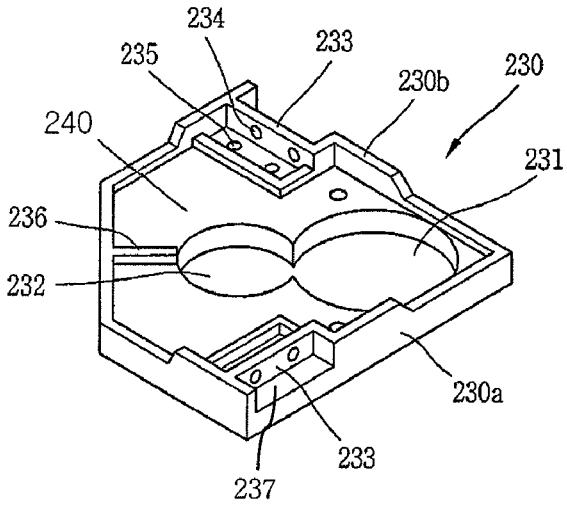
【Fig. 5】
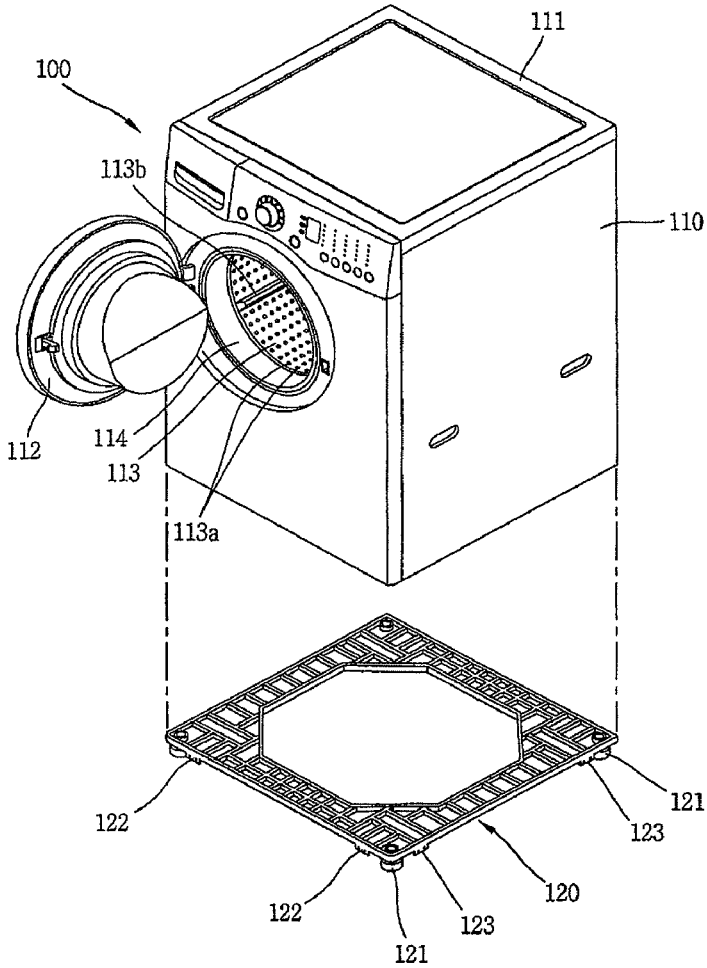

【Fig. 6】
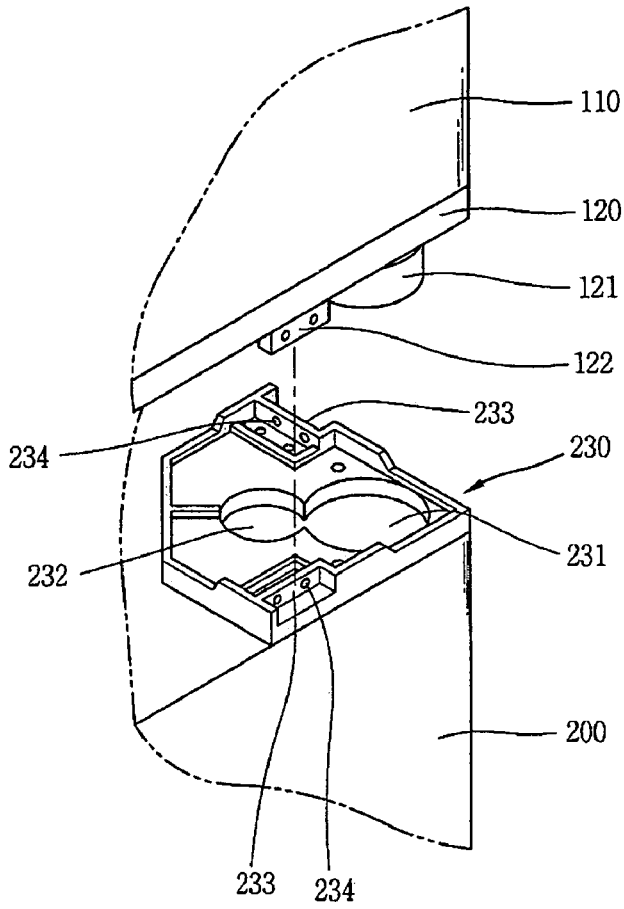
【Fig. 7】
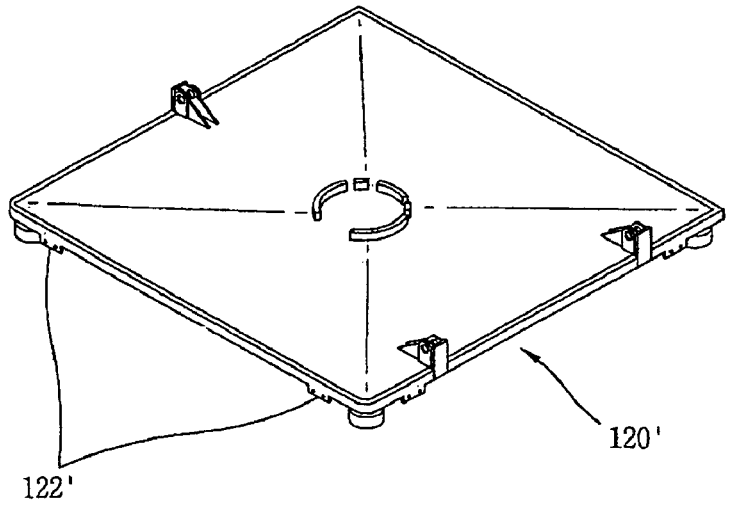

WASHING/DRYING MACHINE

RELATED APPLICATION

The present disclosure relates to subject matter contained in priority Korean Application No. 10-2007-0089181, filed on Sep. 3, 2007, which is herein expressly incorporated by reference in its entirety.

BACKGROUND OF THE INVENTION

1. Field of the Invention

The present invention relates to a washing/drying machine, and more particularly, to mounting a washing/drying machine on a pedestal or other washing/drying machine by using a supporter.

2. Background of the Invention

In general, a washing/drying machine is an apparatus to remove stain (dirt) from clothes, bedclothes, and the like. Such the washing/drying machine may include a washing machine for washing laundry, a drying machine for drying the laundry, a washing/drying machine for performing both the washing and drying operations, and the like. In addition, a refresher has been introduced to remove wrinkles of the laundry or to supply fragrance.

With a recent trend of the washing/drying machine equipped with a pedestal for storing items therein or a supporter, the washing/drying machine, such as the washing machine, the drying machine, the washing/drying machine, etc., is configured to be fixed to an upper surface of the pedestal.

FIG. 1 is an exploded perspective view showing a conventional washing/drying machine having a pedestal. Referring to FIG. 1, the pedestal 20 may include a housing 21 having a certain space therein, and a drawer 22 detachably inserted into the housing 21 for receiving a variety of items therein.

Here, a main body 10 of a washing/drying machine 1 and the pedestal 20 are coupled to each other by a separate coupling member 23 (e.g., a bracket, etc.). An upper end 23*a* of the coupling member 23 is fixed onto one side surface of the washing/drying machine main body 10 by a double-sided tape 24, and a lower end 23*b* of the coupling member 23 is fixed onto one side surface of the housing 21 of the pedestal 20 by screws 25.

Here, a pair of coupling members 23 is installed at each side surface of the main body 10 of the washing/drying machine 1 and the housing 21 of the pedestal 20. That is, the upper end 23*a* of the coupling member 23 is attached to the double-sided tape 24, and both sides of the lower end 23*b* thereof are coupled by the screws 25, thereby being installed between the side surface of a lower end of the main body 10 forming an outer aspect of the washing/drying machine 1 and the side surface of the housing 21 of the pedestal 20.

However, such conventional pedestal 20 cannot be commonly used in the washing machine, the drying machine or the like, and the separate coupling member 23 should be used for coupling the washing/drying machine 1 and the pedestal 20, thereby having a complicated coupling process, reducing productivity, and increasing a manufacturing cost.

In addition, when the washing/drying machine 1 is to be moved or when the coupling member 23 is to be removed so as to install other washing/drying machine to the pedestal, a spot due to the double-sided tape would remain on the surface of either the washing/drying machine 1 or the pedestal 20, or screw holes are generated, thereby deteriorating the external appearance of the product.

In addition, in the process of removing the screws 25 in order to remove the coupling member 23, the surface of the washing/drying machine 1 or the pedestal 20 may be damaged (e.g., dented) or the coupling member 23 may be curved.

SUMMARY OF THE INVENTION

Therefore, an object of the present invention is to provide a pedestal capable of preventing a damage to a surface of the washing/drying machine and the pedestal due to a coupling unit by coupling base ribs formed at a base for supporting a lower portion of the washing/drying machine and coupling ribs of a supporter, facilitating mounting/dismounting the supporter or the pedestal, and not requiring a separate coupling member, and a washing/drying machine having the same.

To achieve this and other advantages and in accordance with the purpose of the present invention, as embodied and broadly described herein, there is provided a washing/drying machine, including: a washing/drying machine main body; and a pedestal for mounting the main body thereon, wherein a base having legs is coupled to a lower end of the main body, and a supporter having coupling ribs for fixing the base to the pedestal is formed at an upper surface of the pedestal.

Here, the supporter includes a main body having leg holes for mounting legs of an object to support thereon, and a plurality of coupling ribs disposed at one side of the main body so as to couple the object to support disposed above or below the main body and the main body to each other.

With such configuration, the object to support and the supporter can be coupled by the coupling ribs. Accordingly, the supporter or the pedestal may be fixed to the object to support without a separate coupling means such as a conventional coupling member, thus to increase productivity.

In addition, at least two coupling ribs are formed at the supporter so as to correspond to an edge of the upper surface of the housing, and coupling holes of a coupling means may be formed at the coupling ribs. Thusly, the coupling ribs are configured to correspond to the edges of the upper surface of the pedestal housing, thereby preventing the supporter from protruding outside of the pedestal housing. Since the coupling holes are formed at the coupling ribs, there is no need to form a separate screw coupling hole on the surface of the pedestal, and damage to the outer aspect of the housing, etc. may be prevented.

In addition, an outer aspect can be maintained in a good condition by preventing the supporter from protruding from the surface of the object to support or the pedestal.

Meanwhile, at least two leg holes for mounting the support legs of the object are formed at the supporter, and the leg holes are communicated with each other or separated from each other. That is, the at least two leg holes are applied in both the washing machine and the drying machine, thus to be commonly used.

Here, the leg holes are formed to have a different depth or size, and the leg holes are disposed on the upper surface of the housing in a diagonal direction. If an object to be coupled to the supporter is the washing machine and the drying machine, legs of the drying machine are positioned inside legs of the washing machine in the diagonal direction. Thusly, the leg holes are disposed on the upper surface of the housing in the diagonal direction, thereby achieving the general use of the components. In addition, considering that the legs of the washing machine and the drying machine have different diameter or thickness, the size or the depth of the leg holes should be formed.

There is provided a washing/drying machine, including: a washing/drying machine main body performing a washing or drying operation of laundry; a base coupled to a lower end of the main body so as to support the main body and having legs; and a pedestal disposed below the main body and for supporting the main body, wherein a supporter having coupling ribs for fixing the main body to the pedestal is mounted at an upper surface of the pedestal.

Here, base ribs coupled to the coupling ribs are formed at the base.

Coupling holes communicated with each other are formed at the coupling ribs and the base ribs. After aligning the centers of the coupling holes with each other, the base and the supporter are coupled by using a screw, etc., thereby preventing the damage to the surface of the washing/drying machine and the pedestal.

Meanwhile, the washing/drying machine main body is one of a washing machine, a drying machine or a washing/drying machine. Washing machine leg holes for receiving legs mounted at the washing machine base and drying machine leg holes for receiving legs mounted at the drying machine base are formed at the supporter.

In addition, the washing machine leg holes and the drying machine leg holes may be communicated with each other or separated from each other. The supporter includes front supporters having leg holes communicated with each other and disposed at both sides on the front end of the upper surface of the pedestal, and rear supporters having leg holes separated from each other and disposed at both sides on the rear end of the upper surface of the pedestal.

Here, at least one of the washing machine leg holes or the drying machine leg holes may be formed to be open. That is, some of the leg holes may be covered so as to prevent the leg from being seen outside, and others may remain in an opened state for facilitating mounting the leg.

The present invention provides a pedestal disposed below the washing machine or the drying machine, and equipped with a supporter having coupling ribs coupled to the base that is mounted at the lower end of the washing machine or the drying machine, thus to be commonly used in the washing machine and the drying machine.

If another washing/drying machine, in addition to the washing/drying machine, is to be placed, the two washing/drying machines may be fixed by using the supporter according to the present invention. That is, the present invention provides a washing/drying machine, including: a first washing/drying machine main body; and a second washing/drying machine main body placed on the first main body, wherein a base having legs is coupled at a lower end of the second main body, and a supporter having coupling ribs for fixing the base to the first main body is mounted at an upper surface of the first main body. Here, the first main body may be the drying machine and the second main body may be the washing machine, and vice versa.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is an exploded perspective view showing a conventional washing/drying machine having a pedestal;

FIG. 2 is an exploded perspective view showing a washing/drying machine having a pedestal according to the present invention;

FIG. 3 is a perspective view showing a state that a supporter is mounted at the pedestal in FIG. 2;

FIG. 4 is a perspective view showing one exemplary supporter in FIG. 3;

FIG. 5 is an exploded perspective view showing a base mounted at the washing/drying machine in FIG. 2;

FIG. 6 is a perspective view showing a state that the base in FIG. 5 is coupled to the supporter; and FIG. 7 is a perspective view showing another exemplary base in FIG. 5.

DETAILED DESCRIPTION OF THE INVENTION

Description will now be given in detail of the preferred embodiments of the present invention, examples of which are illustrated in the accompanying drawings.

FIG. 2 is an exploded perspective view showing a washing/drying machine having a pedestal according to the present invention. FIG. 3 is a perspective view showing a state that a supporter is mounted at the pedestal in FIG. 2, and FIG. 4 is a perspective view showing one exemplary supporter in FIG. 3.

Referring to FIGS. 2 through 4, the washing/drying machine 100 according to the present invention may include a washing/drying machine main body 110 for performing cleaning operations of clothes, a pedestal 200 or a pedestal disposed at one surface of the washing/drying machine main body 110 and for receiving a variety of items required for cleaning the clothes, and a supporter 230 disposed between the pedestal 200 and the washing/drying machine main body 110 so as to connect the pedestal 200 and the main body 110.

The washing/drying machine main body 110 may be one of the washing machine, the drying machine, and washing/drying machine. The pedestal 200 may be disposed at any one of left/right surfaces and upper/lower surfaces of the main body 110, and most preferably, at the lower surface of the main body 110.

Hereinafter, the present invention would describe that the pedestal 200 is disposed below the washing/drying machine main body 110, and the main body 110 is either the washing machine or the drying machine. That is, the pedestal 200 is mounted at a position where the washing/drying machine 100 is to be installed, and then the washing/drying machine (i.e., the washing machine or the drying machine) main body 110 is placed and fixed onto an upper surface of the pedestal 200.

Here, the washing machine as an example of the washing/drying machine 100 may include the main body 110 forming an external appearance, a tub (not shown) disposed inside the main body 110 in a horizontal direction so as to be dampered (attenuated) and for receiving water therein, a drum 113 rotatably mounted inside the tub for receiving clothes therein, and having a plurality of through-holes 113*a* at an outer surface thereof so as to pass water or foam therethrough, a plurality of lifters 113*b* mounted at an inner surface of the drum 113 and lifting laundry such that the laundry is dropped at a certain height by gravity, and a motor (not shown) mounted rear the tub for rotating the drum 113.

A main body cover (not shown) is disposed at the front surface of the main body 110, and a base 120 is mounted at a lower surface of the main body 110. A top plate 111 is mounted at the upper surface of the main body 110.

An entrance opening, through which the laundry is introduced into or removed from the drum 113, is formed in the main body cover, and a door 112 for opening/closing the entrance opening is rotatably mounted at one side of the entrance opening. A gasket 114 for attenuating an impact by a rotation of the drum 113 as well as serving as a packing to prevent water from overflowing is installed between the tub and the door 112.

A height adjustable leg 121 for supporting a load of the washing/drying machine (i.e., the washing machine) main body 110 is mounted at each of four corners of the base 120 so as to be ascendable or descendable.

The legs 121 are coupled to the base 120 by a coupling means such as screws, or the like. If the legs 121 are rotated in one direction, the legs 121 are configured to protrude from the base 120, thereby increasing an installation height of the washing/drying machine 100. If the legs 121 are rotated in another direction, the legs 121 are configured to be inserted into the base 120, thereby reducing the installation height of the washing/drying machine 100.

The pedestal 200 may include the box-shaped housing 210 formed to have an area enough to place the washing/drying machine 100 thereon, and a drawer 222 openably disposed at a front surface of the housing 210 so as to receive a variety of items inside the housing 210.

The housing 210 and the drawer 222 may be formed of an injection molded plastic.

The supporter 230 for fixing the legs 121 of the washing/drying machine 100 may be installed at each of the four corners of the upper surface of the housing 210, and a leg (not shown) for supporting the load of the washing/drying machine 100 and the pedestal 200 as well as for adjusting the height of the pedestal 200 may be installed at each of the four corners of the lower surface of the housing 210.

The drawer 222 may include a front surface portion 221 disposed at the front surface of the housing 210 and having a handle 223, and a receiving portion 220 formed at a rear surface of the front surface portion 221 for receiving a variety of items therein and openably disposed inside the housing 210.

Accordingly, the pedestal 200 serves as a supporter of the washing/drying machine 100 as well as a container for receiving a variety of items required when using the washing/drying machine 100, such as a detergent, a fabric conditioner, a bleach, maintenance tool, cleaning tool, and the like.

Referring to FIGS. 3 and 4, the supporters 230 are mounted at the upper surface of the housing 210 of the pedestal 200, and preferably, at each of the four corners of the upper surface thereof.

The supporter 230 may include a main body 240 having leg holes 231, 232 for mounting the legs 121 of the washing/drying machine 100 as an object to support thereon, and a plurality of coupling ribs 233 disposed at one side of the main body 240 and for coupling the washing/drying machine 100 and the main body 240 to each other.

Here, if the washing/drying machine 100 is the washing machine, first leg holes 231 for mounting the legs 122 of the washing machine may be provided. If the washing/drying machine 100 is the drying machine, second leg holes 232 for mounting the legs 123 of the drying machine may be provided. If the washing/drying machine 100 is a refresher, etc., other than the washing machine or the drying machine, leg holes for receiving the legs of the refresher may also be provided. That is, the first and second leg holes 231, 232 are not meant to be applied only to the washing machine and the drying machine. Therefore, preferably, at least two or more leg holes 231, 232 are provided for a general use of the supporters 230.

The plurality of supporters 230 may be divided into front supporters 230' mounted at the front of the upper surface of the housing 210, and rear supporters 230" mounted at the rear of the upper surface thereof. Here, the front supporters 230' include the leg holes 231, 232 communicated with each other, and are respectively mounted at both sides of the front end of the upper surface of the housing 210. The rear supporters 230" include the leg holes 231, 232 separated from each other, and are respectively mounted at both sides of the rear end of the upper surface of the housing 210.

Here, the reason why the leg holes 231, 232 of the front supporters 230' and the rear supporters 230" have a different configuration is that positions of each leg are different in the washing/drying machine 100 having the main body 110 of the same size.

For instance, if the washing/drying machine 100 is the washing machine and the drying machine, the front legs of the washing machine and the front legs of the drying machine are overlapped to each other. However, the rear legs of the washing machine and the rear legs of the drying machine are not overlapped to each other. Accordingly, the leg holes 231, 232 of the front supporters 230' should be communicated to each other, and the leg holes 231, 232 of the rear supporters 230" should be separated from each other, thereby being able to be used in both the washing machine and the drying machine.

Here, such described configurations of the leg holes are not meant to be limiting, and the shape of the leg holes 231, 232 may be changed according to the shape of the legs of the washing/drying machine 100 to be used.

In addition, the leg holes 231, 232 may be formed to have different depths or sizes. This is to receive a variety of leg shapes as much as possible even though a thickness, a diameter or a size of the legs 121 are all different according to the type of the washing/drying machine 100, thus to enable the components to be widely (generally) used.

Meanwhile, if the leg holes 231, 232 are formed to have the same depth, a separate member (e.g., a sheet-shaped washer) may be mounted at the legs 121, so that the depth of the leg holes 231, 232 and the height of the legs 121 can be adjusted.

In addition, at least one of the leg holes 231, 232 may be formed to be open. That is, some of the leg holes 231, 232 may have a covered upper portion, and others may remain in an opened state. This may prevent the legs 121 of the washing/drying machine 100 from being seen outside. Further, the washing/drying machine 100 may be firmly mounted at the pedestal 200 by stopping (locking) the legs 121 of the washing/drying machine 100 by the covered portion of the leg holes 231, 232.

Meanwhile, the leg holes 231, 232 may be formed at the upper surface of the housing 210 in a diagonal direction. Such arrangement of the leg holes 231, 232 may be determined by an arrangement of the legs 121 of the washing/drying machine 100 to be used.

Description of the supporters 230 will be given in detail.

As shown in FIG. 4, the supporter 230 may include the main body 240 having an approximately rectangular or fan shape, and the leg holes 231, 232 formed at a central portion of the main body 240. Here, the leg holes 231, 232 may be formed to be communicated or separated, as described above.

When the supporters 230 are mounted at the upper surface of the housing 210 of the pedestal 200, the coupling ribs 233 are formed at a first side surface 230*a* and a second side surface 230*b* each corresponding to the corners of the housing 210. That is, it is effective that the coupling rib 233 is formed at an edge of the supporter 230 so as to correspond to an edge of the upper surface of the housing 210.

Preferably, the coupling rib 233 is formed at each of the first side surface 230*a* and the second side surface 230*b*. However, two or more coupling ribs 233 may be formed at each of the side surfaces 230*a*, 230*b* in consideration of a size of the pedestal 200, or a size and a load of the washing/drying machine 100 to be mounted on the pedestal 200, and the like.

Preferably, the coupling ribs 233 are disposed inside the side surfaces 230*a*, 230*b*with a stepped portion 237 from the first and second side surfaces 230*a*, 230*b*. This is to prevent a screw head or a bolt head from being more protruded than the side surfaces 230*a*, 230*b*when a coupling means such as a screw, a bolt, etc. is mounted at the coupling holes 234 formed at the coupling ribs 233 for coupling to the washing/drying machine 100.

In addition, coupling holes 235 of the coupling means to mount the supporter 230 to the pedestal 200 are formed at the main body 240 at almost the right angle to the coupling ribs 233. It is effective that, in consideration of a thickness of a head of the coupling means, a portion where the coupling holes 235 are formed is positioned inside the surface of the supporter main body 240.

At least one reinforcing rib 236 is disposed at the rear of the leg holes 231, 232. This reinforcing rib 236 is to prevent a reduction of rigidity of the leg holes 231, 232 in the rear direction as well as to reduce an amount of the injection-molded plastic used to manufacture the supporter 230. That is, the amount of injection-molded plastic of the supporter 230 may be reduced by having a relatively thinner thickness of the portion except the reinforcing rib 236.

Here, the coupling ribs 233 are respectively disposed at the first and second side surfaces 230*a*, 230*b* in parallel, however, the coupling ribs 233 may also be disposed perpendicular to the first and second side surfaces 230*a*, 230*b*. This is because a shape of the coupling rib 233 is determined by a shape of the rib of the washing/drying machine 100 coupled to the coupling rib 233.

Hereinafter, description of a base of the washing/drying machine 100 coupled to the coupling ribs 233 will be given in detail.

FIG. 5 is an exploded perspective view showing a base mounted at the washing/drying machine in FIG. 2, FIG. 6 is a perspective view showing a state that the base in FIG. 5 is coupled to the supporter, and FIG. 7 is a perspective view showing another exemplary base in FIG. 5.

Referring to FIG. 5, height-adjustable legs 121 are respectively mounted at four corners of a base 120, and base ribs 122 are respectively formed at both sides of the leg 121. The base ribs 122 include coupling holes 123 to be communicated with the coupling holes 234 at the coupling ribs 233 of the supporter 230.

In order for the washing/drying machine 100 to be mounted at the pedestal 200, the supporter 230 is disposed between the washing/drying machine 100 and the pedestal 200, and then a coupling means (e.g., a screw, etc.) is mounted at the coupling holes 123, 234 in a state that the coupling ribs 233 of the supporter 230 and the base ribs 122 are aligned with each other.

FIG. 6 illustrates that the washing/drying machine 100, the supporter 230 and the pedestal 200 are coupled together by using the coupling ribs 122, 233.

Referring to FIG. 6, the coupling ribs 233 of the supporter 230 are positioned outside the base ribs 122, and the coupling means (e.g., a screw, etc.) is mounted at the coupling holes 123, 234, thereby coupling the coupling ribs 233 and the base ribs 122 to each other. With this configuration, the coupling ribs 122, 233 cannot protrude more than the surface of the washing/drying machine 100 or the pedestal 200, thus to provide a good outer aspect. Besides, there is no need to use a separate component such as a bracket, etc. for mounting the washing/drying machine 100 or the pedestal 200 to the supporter 230.

To be certain, the base ribs 122 may be positioned outside the coupling ribs 233 of the supporter 230.

The base 120, as shown in FIG. 5, is formed to have a honeycomb or grid shape, and a base 120', as shown in FIG. 7, may be formed to have a plate shape having base ribs 122'. Such described shape of the base 120, 120' may be changed according to the washing/drying machine 100.

As described above, by using the coupling ribs 122 of the base 120, the pedestal 200 may be commonly used in a variety of the washing/drying machine 100 including the washing machine and the drying machine, without a separate coupling member (e.g., a bracket, etc.).

Meanwhile, the present applicant has described the washing machine and the drying machine as an example of the washing/drying machine, however, without being limited thereto, the washing/drying machine may also include other types of washing/drying machine, such as an integrated washing system, a refresher equipped with a wrinkle reduction function, and the like.

In addition, the configuration that the washing/drying machine is installed on the pedestal having the supporter therebetween has been described, however, without being limited thereto, the washing/drying machine may be disposed in a vertical direction having the supporter therebetween. For instance, the drying machine is disposed above the washing machine, and the drying machine to be placed on the washing machine may be fixed by using the supporter according to the present invention. Alternatively, the washing machine is disposed above the drying machine, and the washing machine to be placed on the drying machine may be fixed by using the supporter according to the present invention. In addition, a front loading type washing/drying machine has been described, however, a top loading type washing/drying machine is also included in the scope of the present invention.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A washing/drying machine, comprising:

a washing/drying machine main body; and a pedestal for placing the main body thereon, wherein a base having legs is coupled to a lower end of the main body, and a supporter having coupling ribs for fixing the base to the pedestal is formed at an upper surface of the pedestal, wherein the supporter is mounted at each of four corners of an upper surface of the pedestal such that each side surface of the supporter is aligned with an edge of the upper surface of the pedestal, wherein the coupling ribs are formed with a stepped portion of a certain size from the side surface of the supporter toward the inside thereof, and wherein base ribs coupled to the coupling ribs of the supporter are formed at the base.

2. The washing/drying machine of claim 1, wherein the legs are mounted at the base by using a screw for height adjustment.

3. The washing/drying machine of claim 1, wherein coupling holes are respectively formed at the coupling ribs and the base ribs in a corresponding shape to each other.

4. The washing/drying machine of claim 1, wherein the supporter includes leg holes for receiving the legs mounted at the base.

5. The washing/drying machine of claim 4, wherein the leg holes are comprised of a first leg hole and a second leg hole, and the first and second leg holes are communicated with each other or separated from each other.

6. The washing/drying machine of claim 5, wherein the first and second leg holes are formed at the upper surface of the pedestal in a diagonal direction.

7. The washing/drying machine of claim 6, wherein if the washing/drying machine is a washing machine, the first leg hole receives legs mounted at a base of the washing machine, and if the washing/drying machine is a drying machine, the second leg hole receives legs mounted at a base of the drying machine.

8. A washing/drying machine, comprising:

a first washing/drying machine main body; and a second washing/drying machine main body placed on the first main body, wherein a base having legs is coupled at a lower end of the second main body, and a supporter having coupling ribs for fixing the base to the first main body is mounted at an upper surface of the first main body, wherein the supporter is mounted at each of four corners of an upper surface of the first main body such that each side surface of the supporter is aligned with an edge of the upper surface of the first main body, wherein the coupling ribs are formed with a stepped portion of a certain size from the side surface of the supporter toward the inside thereof, and wherein base ribs coupled to the coupling ribs of the supporter are formed at the base.

9. The washing/drying machine of claim 8, wherein the legs are mounted at the base by using a screw for height adjustment.

10. The washing/drying machine of claim 8, wherein coupling holes are respectively formed at the coupling ribs and the base ribs in a corresponding shape to each other.

11. The washing/drying machine of claim 8, wherein the supporter includes leg holes for receiving the legs mounted at the base.

12. The washing/drying machine of claim 11, wherein the leg holes are comprised of a first leg hole and a second leg hole, and the first and second leg holes are communicated with each other or separated from each other.

13. The washing/drying machine of claim 12, wherein the first and second leg holes are formed at the upper surface of the first main body in a diagonal direction.

14. The washing/drying machine of claim 13, wherein if the second main body is a washing machine, the first leg hole receives legs mounted at a base of the second main body, and if the second main body is a drying machine, the second leg hole receives legs mounted at a base of the second main body.

* * * * *